US006922974B2

(12) United States Patent
Daniel et al.

(10) Patent No.: US 6,922,974 B2
(45) Date of Patent: Aug. 2, 2005

(54) THREE-PART WIRE RETURN FOR BALING MACHINE

(75) Inventors: Barton Wade Daniel, Kennesaw, GA (US); Gerald Lee Johnson, Carthage, MO (US); Samuel E. Jones, Carthage, MO (US); Harold Campbell Lummus, Jr., Cataula, GA (US); Craig Val Millett, Granby, MO (US); Timothy Charles Stamps, Carl Junction, MO (US); Ray Whittinghill, Carthage, MO (US)

(73) Assignee: L & P Property Management Company, South Gate, CA (US)

( * ) Notice: Subject to any disclaimer, the term of this patent is extended or adjusted under 35 U.S.C. 154(b) by 0 days.

(21) Appl. No.: 10/166,745

(22) Filed: Jun. 11, 2002

(65) Prior Publication Data

US 2002/0170443 A1 Nov. 21, 2002

Related U.S. Application Data

(62) Division of application No. 09/540,020, filed on Mar. 31, 2000, now Pat. No. 6,553,900.

(51) Int. Cl.[7] ..... B65B 13/20

(52) U.S. Cl. ..... 53/399; 53/438; 100/3; 100/31

(58) Field of Search ..... 100/2, 3, 16, 25, 100/26, 29, 31; 53/529, 589, 399, 438

(56) References Cited

U.S. PATENT DOCUMENTS

| | | | | |
|---|---|---|---|---|
| 2,632,381 A | | 3/1953 | Buckland | |
| 2,780,986 A | | 2/1957 | Ritenour | |
| 2,959,118 A | * | 11/1960 | Hager | 100/26 |
| 3,070,001 A | | 12/1962 | Feldkamp | |
| 3,470,813 A | | 10/1969 | Nömm et al. | |
| 3,475,879 A | * | 11/1969 | Merkel et al. | 100/25 |
| 3,521,550 A | * | 7/1970 | Van Doorn et al. | 100/26 |
| 3,568,591 A | | 3/1971 | Dunlap | |
| 3,621,888 A | | 11/1971 | Ericsson | |
| 3,701,314 A | * | 10/1972 | Tull, III | 100/26 |
| 3,720,158 A | | 3/1973 | Sauer et al. | |
| 3,834,297 A | | 9/1974 | Huson | |
| 3,863,558 A | | 2/1975 | Trumbo | |
| 3,889,584 A | * | 6/1975 | Wiklund | 100/26 |
| 3,889,585 A | * | 6/1975 | Morrow | 100/26 |

(Continued)

FOREIGN PATENT DOCUMENTS

| | | | | |
|---|---|---|---|---|
| JP | 04142217 A | * | 5/1992 | B65B/27/12 |
| JP | 05294318 A | * | 11/1993 | B65B/27/12 |

OTHER PUBLICATIONS

Videotape; Cranston Wire Tying; approximate date 1985; approximate length 4 minutes.

Videotape; Samuels Strapping System; Mosely Gin, Abbeville, AL; date as early as Mar. 31, 2000; approximate length 4 minutes.

Brochure; "Packaging Solutions for Large Products", Automat, Barcelona Spain, Undated, 16 pages.

*Primary Examiner*—Stephen F. Gerrity
(74) *Attorney, Agent, or Firm*—Husch & Eppenberger, LLC; Grant D. Kang

(57) ABSTRACT

The invention is a baling machine with an articulated guide track disposed in three operationally distinct sections. One section of the articulated guide track, representing approximately one-half of the track perimeter, is movable between a first position and a second position. In the first position, the large section completes a guide track perimeter. In the second position, the large section pivots away from tying heads of the baling machine to permit ejection of the bale from the machine.

30 Claims, 3 Drawing Sheets

U.S. PATENT DOCUMENTS 3,910,089 A 10/1975 Meier et al.
3,921,799 A 11/1975 Meier
3,935,616 A 2/1976 Simmons
3,974,763 A * 8/1976 Van Doorn et al. ..... 100/35
4,031,594 A 6/1977 Cepuritis
4,048,697 A 9/1977 Duenser
4,062,086 A 12/1977 Wojcik
4,079,667 A 3/1978 Lems et al.
4,080,689 A 3/1978 Meier
4,090,440 A 5/1978 Jensen
4,156,385 A 5/1979 Lems et al.
4,158,994 A 6/1979 Jensen
4,226,007 A 10/1980 Duenser
4,228,565 A 10/1980 Lems et al.
4,378,262 A 3/1983 Annis, Jr.
4,391,186 A 7/1983 Davis
4,403,542 A 9/1983 Lewis
4,450,763 A 5/1984 Saylor
4,466,535 A 8/1984 Huson
4,484,518 A 11/1984 Jaenson
4,501,356 A 2/1985 Urban et al.
4,520,720 A 6/1985 Urban et al.
4,534,817 A 8/1985 O'Sullivan
4,566,378 A * 1/1986 Fleissner ..... 100/26
4,584,935 A 4/1986 Luggen
4,611,534 A 9/1986 Kudlicka et al.
4,625,635 A 12/1986 Lewis
4,649,812 A 3/1987 Mouret
4,665,815 A 5/1987 Fleissner
4,787,425 A 11/1988 Saylor
4,951,562 A 8/1990 Ribaldo
5,039,250 A 8/1991 Janz
5,070,779 A 12/1991 Molitorisz
5,117,536 A 6/1992 Beach et al.
5,133,532 A 7/1992 Figiel et al.
5,379,687 A 1/1995 Moseley
5,417,320 A 5/1995 Velan et al.
5,477,724 A 12/1995 Velan et al.
5,483,837 A 1/1996 Velan et al.
5,546,855 A 8/1996 Van Doorn et al.
5,644,978 A 7/1997 Jaenson et al.
5,673,614 A 10/1997 Jaenson et al.
5,689,934 A 11/1997 Scherer et al.
5,746,120 A 5/1998 Jonsson
5,826,499 A 10/1998 Bullington
5,870,950 A 2/1999 Wiedel

* cited by examiner

THREE-PART WIRE RETURN FOR BALING MACHINE

CROSS-REFERENCE TO RELATED APPLICATION

This application is a division of U.S. patent application Ser. No. 09/540,020, filed Mar. 31, 2000, now U.S. Pat. No. 6,553,900, and claims priority thereto.

STATEMENT REGARDING FEDERALLY SPONSORED RESEARCH OR DEVELOPMENT

Not Applicable.

BACKGROUND OF THE INVENTION

1. Field of the Invention

This invention relates generally to a wire bale binding machine that utilizes a three section return track for guiding wire around a bale of bulk fibrous material. Fibrous materials include cotton and nylon.

2. Related Art

Fibrous bulk materials include cotton and nylon. Fibrous bulk materials are commonly formed into bales by compression and binding. There is a continuing need in the art to improve this bale binding process by improving efficiency, reliability and accuracy. There are various constraints on improvements to the bale binding process including: (1) the nature of the fibrous material; (2) the compressive force or loading; and (3) the loading of the fibrous material into a bale compression box; (3) wrapping baling wire around the bale.

Baling wire or baling strap performance requirements vary depending on the bulk material at issue. Such requirements range from general operational parameters to industry to standard specifications. The Cotton Council has a baling constraint wherein the length of the wire (or strap) around the bale must fall within a particular range and the tension that the wire (or strap) must withstand has a particular range.

U.S. Wire Tie, a company based in Carthage, Mo., has an existing system, the 340 Series, for baling bulk materials. This system uses a hydraulic twist knot wire tying system to bind bales. In such systems, 8 gauge wire is utilized as the baling wire. However, hydraulic systems are slowly becoming less desirable because any leak of hydraulic fluid onto the bulk material ruins the material and requires that the baling equipment be cleaned prior to restarting the baling operation. To avoid the ruination of bulk material and prevent the loss of operational time and avoid the accompanying cleaning costs, this, there is a need in the art to provide a power source for a baling machine that does not use hydraulic fluid.

As the inventors have explored the feasibility of electric systems, it has been discovered that such systems require electrically-powered, knot-tying heads that are substantially larger than hydraulic knot-tying heads. This larger dimension, however, results in an inability to feed the wire around the bale with enough clearance from the bale to permit tying and still fall within the required length and strength specifications of the Cotton Council.

Design, construction and operation of a bale forming and binding apparatus is also complicated by the often conflicting requirements of providing a means to precisely apply a binding to the bale simultaneous with the compression process. Thus, an immovable strapping guide can improve the accuracy and efficiency of the application of the strapping at the potential cost of complicating bale forming and output. A separable strapping guide can avoid these costs but can present impediments to the precise application of the strapping. Additional requirements to further coordinate cotton input, strapping feed and bound bale output present substantial impediments to the operational speed and accuracy of the bale binding system.

Operational speed and accuracy is also dependent upon the speed of the application of baling wire to a bale and the release of a bale. In manually-assisted systems, two workers assume positions on each side of a bale. As the compression box is filled with fibrous material and compressed, the compression is held until the workers can slide six wire ties under the bale. Once the ties are in place, the machine bends each tie around the bale such that the tie connectors on each end of each tie connect. Then, the compressive force on the bale is released and the bale expands in volume until limited by the baling ties.

Automated systems include the use of plastic straps which are threaded around a bale, with the ends being welded together.

There is a need in the art to provide an automated, non-hydraulic, non-plastic baling machine that provides operational speed and reliability.

SUMMARY OF THE INVENTION

It is in view of the above problems that the present invention was developed. The invention is a baling machine with an articulated guide track disposed in three operationally distinct sections. One section of the articulated guide track, representing approximately one-half of the track perimeter, is movable between a first position and a second position. In the first position, the large section completes a guide track perimeter. In the second position, the large section pivots away from tying heads of the baling machine to permit ejection of the bale from the machine.

The present invention accurately aligns a movable guide track section with a stationary guide track section. The invention utilizes electric and pneumatic power to avoid difficulties associate with hydraulically powered systems.

The guide track has specific curvature limitations which have been discovered to enhance operational speed, efficiency, and enablement. Specifically, the radius of curvature for the lower or bottom sections of the guide track is seven inches. The radius of curvature for the upper or top sections of the guide track is six inches. The invention utilizes number ten gauge wire within a guide track having these particular radius of curvature dimensions. It is believed that this is the first time that number ten gauge wire has ever been used in a baling environment for bailing five hundred pound bales of cotton. Prior art track curvatures were nine inches utilizing number eight gauge wire.

Further features and advantages of the present invention, as well as the structure and operation of various embodiments of the present invention, are described in detail below with reference to the accompanying drawings.

BRIEF DESCRIPTION OF THE DRAWINGS

The accompanying drawings, which are incorporated in and form a part of the specification, illustrate the embodiments of the present invention and together with the description, serve to explain the principles of the invention. In the drawings.

DETAILED DESCRIPTION OF THE PREFERRED EMBODIMENTS

Figure 1:
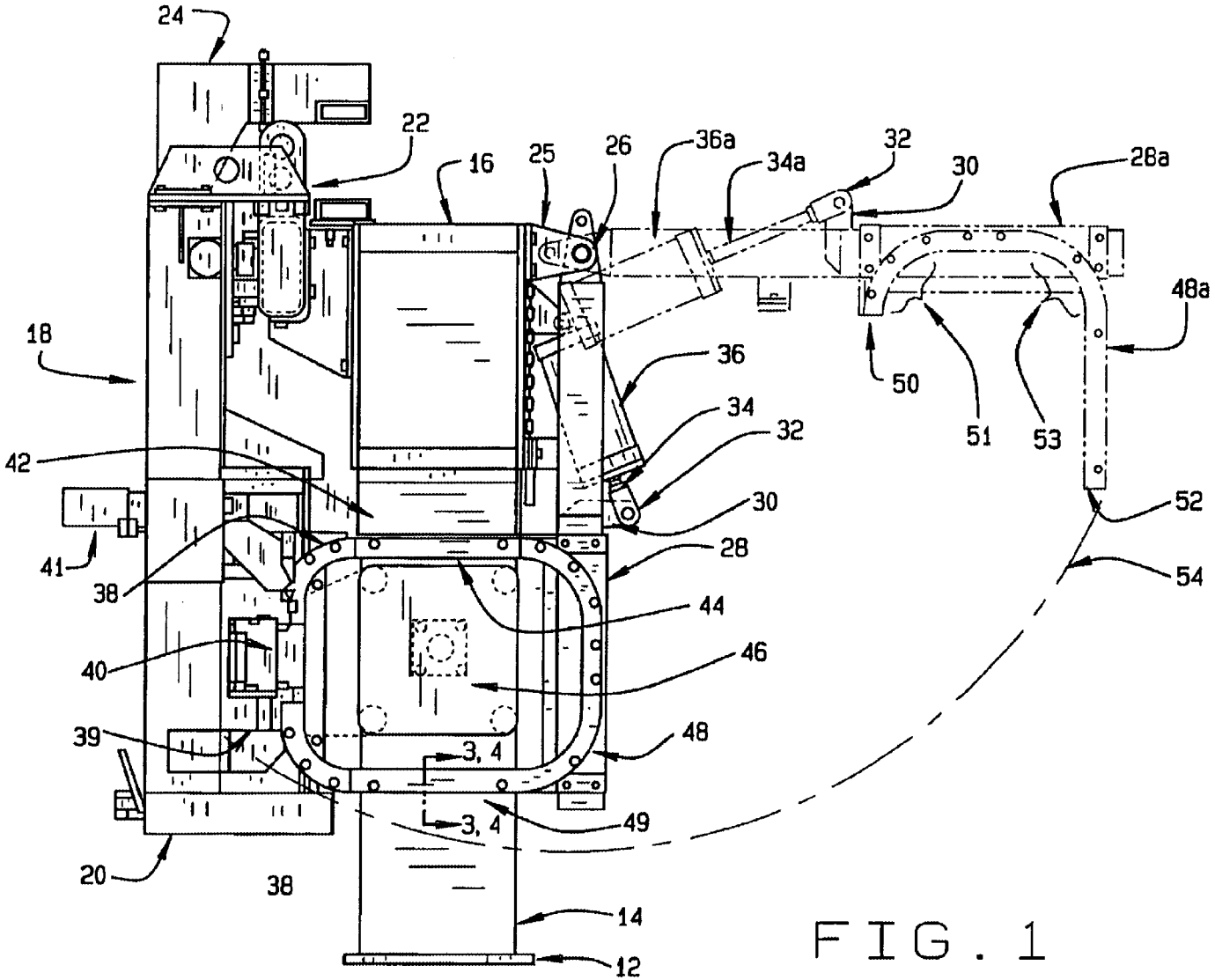
FIG. 1 is a side view of the preferred embodiment of the present invention.

Referring to the accompanying drawings in which like reference numbers indicate like elements, FIG. 1 illustrates a side view of the preferred embodiment of the present invention. A bale forming and binding apparatus 10 has two positions; the solid lines illustrate a first position wherein the movable wire guide section 48 completes the wire guide track trajectory as when the binding operation is occurring; and the broken lines illustrate a second position wherein the movable wire guide section 48 is in a position 48*a*. A floor plate 12 supports vertical support stands 14 on either side of the bale forming and binding station 16. A binding assembly carriage 18 is borne by stands 14. The base extension 20 of the carriage 18 carries the fixed tying heads 40 and attached wire guide track sections 39. The carriage 18 translates in a direction perpendicular to the plane of the drawing along an overhead track 22 attached to the upper rear extent of the stands 14 and its motion is controlled by drive 24.

Extending from the upper forward extent of the stands 14 are a pair of pivot axis brackets 25 holding the pivot axis 26 which carries the movable guide track support strut assembly 28. Extending forward from the center of the strut assembly 28 is a member 30 pivotally connected at pin 32 to the piston arm 34 which is extended and withdrawn by action of the piston 36. The action of the piston 36 may be by any means but is preferably pneumatic.

The binding wire entering the apparatus 10 from the wire supply (not shown) at the wire control head 41 are directed by guide track sections 38 to and from the tying head 40 which fastens the wire into a closed loop. The guide track section 44 lies in a channel within the bale forming compressor 42 which accommodates the wire trajectory above the bale forming station 46 containing the bulk material (not depicted). The positions 28*a*, 34*a*, 36*a* and 48*a* show the parts 28, 34, 36 and 48 in their respective positions when the apparatus is in the arrangement whereby the movable guide track section is at a remove from the bale forming station 46. The upper movable guide track section terminus 50 and the lower movable guide track section terminus 52 meet the guide track sections 46 and 38 respectively to complete the wire guide track. The dashed line 54 illustrates the path of motion of the lower terminus 52 as it transits between positions. Movable guide track section 48 has an upper curve 51 and a lower curve 53 both of approximately ninety degrees and possessing radii of curvature of approximately six inches and approximately seven inches, respectively.

Figure 2:
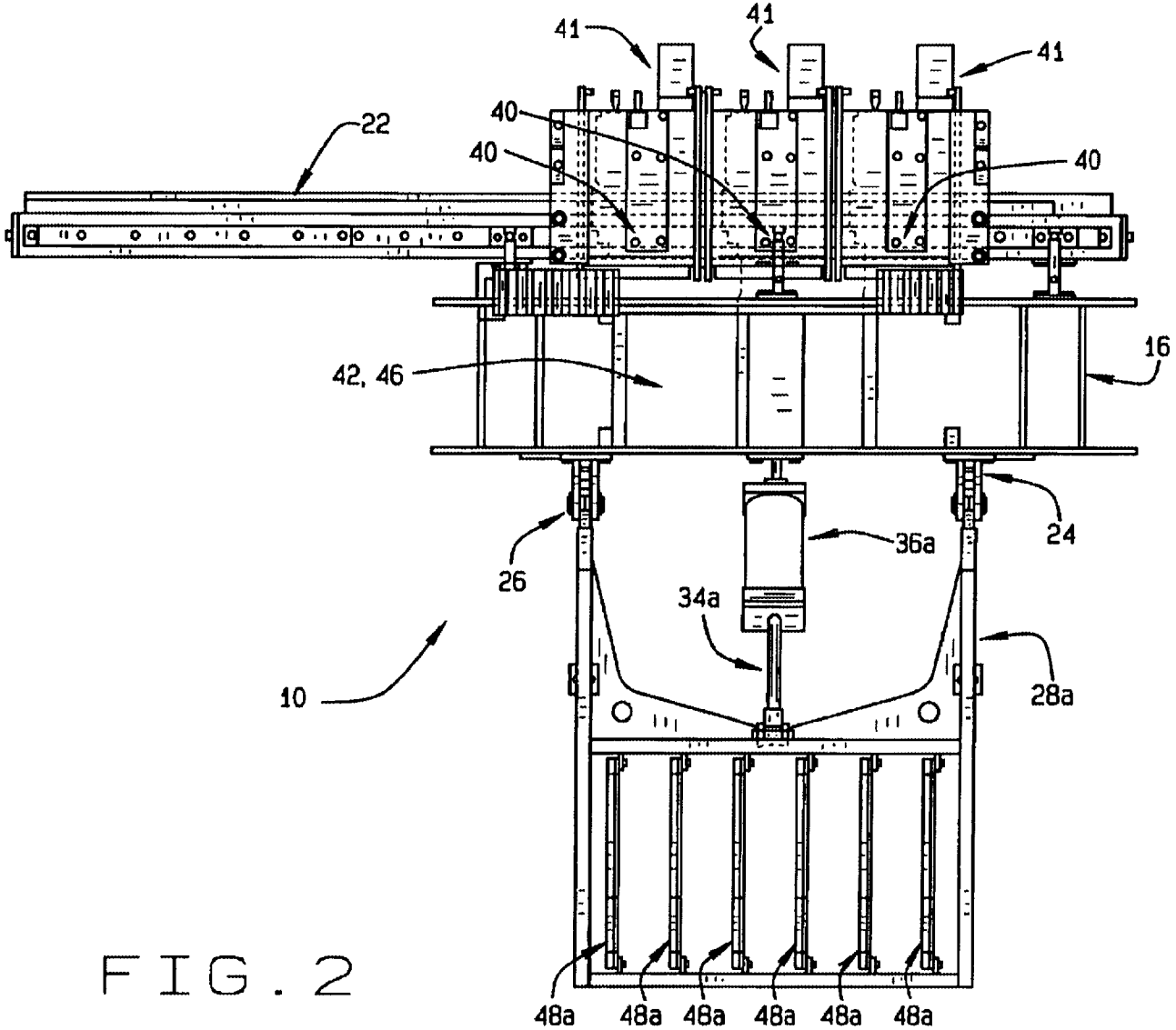
FIG. 2 is a top view of the preferred embodiment of the present invention.

FIG. 2 depicts a top view of the apparatus in the arrangement with the movable guide track sections 48 in the removed positions 48*a* with the forward direction being towards the bottom of the page. The parts and positions are as numbered in FIG. 1. The plurality of identical guide tracks 48*a* numbering six in total, disposed side by side from left to right, are shown as are the tying heads 40 numbering three in total. When binding operation is occurring the tying heads align with alternating guide tracks and then shuttle to the side one track and repeat to thereby complete the closing of six wire bindings in two operations. Alternatively, if there are only two tying heads, three iterations are required to apply six wire bindings.

Figure 3:
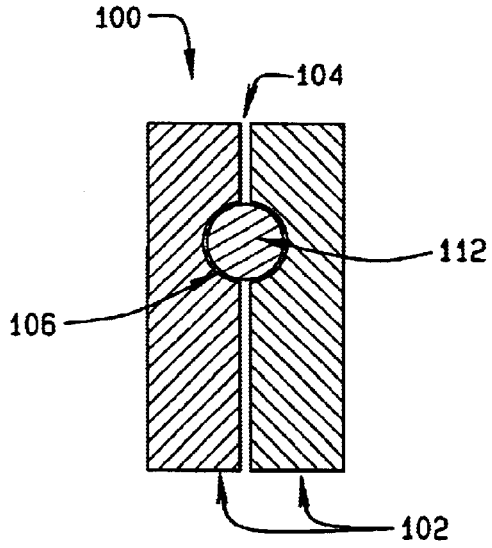
FIG. 3 and FIG. 4 are cross-section views taken along lines 3—3 and 4—4, respectively of FIG. 1 illustrating the different operational aspects of a wire track guide.

FIG. 3 depicts a cross-sectional view of a wire track 100 construction in a closed state for the directing and fastening of the wire 112 about the bale. The two sides 102 of the track 100 are separated by a gap 104 which is shown as closed thereby forming the channel 106.

Figure 4:
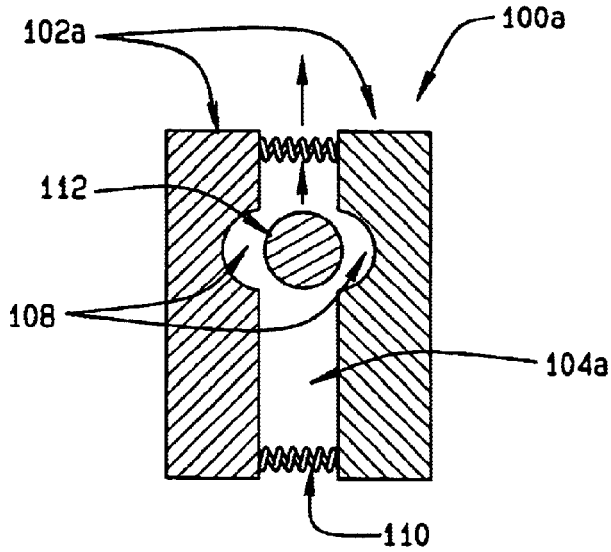

FIG. 4 depicts a cross-sectional view of a wire track 100*a* construction in an open state for the releasing during fastening of a closed loop of the wire 112 in the direction shown by the arrow towards the compressed bale (not depicted) from between the sides 102*a* now separated to release the wire through the open gap 104*a*. Hollows 108 combine to form the two sides of channel 106 when in the closed position. Spring means 110 mediate the transition of the track between the closed and the open positions.

In operation, when the movable guide track support strut assembly 28 is down, the binding wire entering the apparatus 10 from the wire supply (not shown) at the wire control head 41 and enters the tying head 40. Within tying head 40, the wire is gripped by a gripper (not shown). The gripper (not shown) rotates to push wire frictionally through the tying head 40 downward to the lower most guide track sections 38 and across, up, back, and then down the other guide track sections 38, and then back into tying head 40 until the end of the wire actuates a limit switch (not shown). The wire thus forms a loop section with an overlapping wire portion located within tying head 40. It is preferred to use ten (#10) gauge wire that is sold by U.S. Wire under the trade name ULTRA STRAP GALVANIZED.

At this point, tie pins 64*a* and 64*b*, respectively, are extended. The tying head 40 twists the wire into a knot. In order to effect tying, tension is placed on the wire. This tension pulls the wire out of the two sides 102 as shown by the releasing action in FIGS. 3 and 4. As the wire is tensioned and breaks out of channel 106, the wire is pulled around pins 64*a* and 64*b*, respectively. This assists the wire in assuming a less sharp bend.

Once the tying head 40 has completed the twist knot, tie pins 64*a* and 64*b*, respectively, are retracted by solenoid (not shown) which retraction pulls tie pins 64*a* and 64*b*, respectively, out of contact with the wire.

Then, carriage 18 can translate to a second indexed position along overhead track 22. Wire is again drawn by gripper (not shown) within tying head 40 to push the wire in a loop through guide track sections 38 and back into tying head 40. Then, the twist knot process repeats.

For cotton bales, six baling wires are used to bind a five hundred pound bale of cotton. Thus, if three indexing heads are mounted to carriage 18, carriage 18 must index between a first position and a second position to provide six straps.

Figure 5:
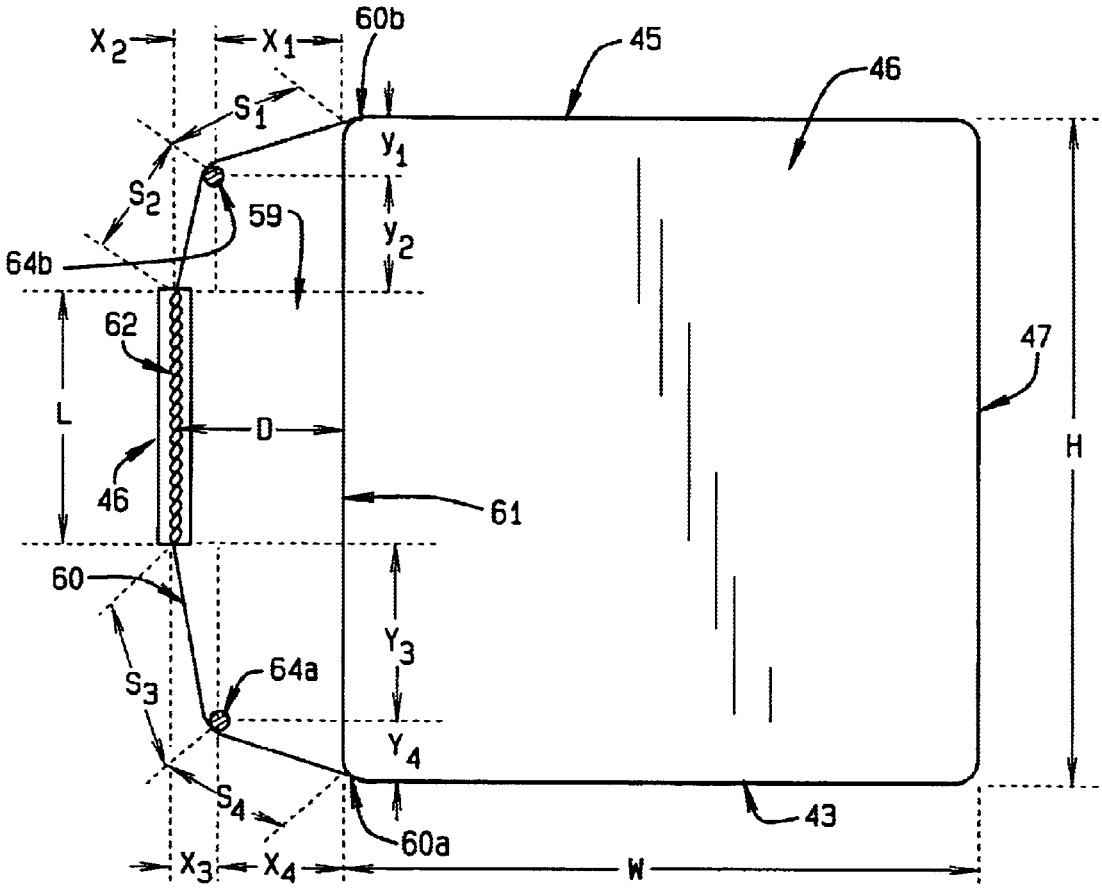
FIG. 5 is a schematic diagram of the binding strapping path, the bale form and the fastening head of the present invention.

FIG. 5 illustrates diagrammatically the strapping path above 45, behind 47 and below 43 of the bale form 46 when the wire tying action is occurring. The wire is tied in a twist knot 62 within the tying head 40. The free strapping segment 60 extends upward and downward from the ends of the tying head 40 around an upper pilot pin 64*b* and a lower pilot pin 64*a*, respectively, to contact with the perimeter of the bale form 46 at points 60*a* and 60*b*, respectively, which are at the upper and lower ends of the front side 61 of the bale form 46. Quantities of distance separating aspects of FIG. 5 are indicated by letters. The height H is the separation between the wire paths 43 and 45 and the width W is the separation between the path 47 and the front side 61. The tying head 40 produces a wire knot 62 of length L which is separated from the front side 61 by a distance D. The free strapping segment is subdivided into segment parts of lengths $s_1$ through $s_4$ corresponding in order to the distances along the free strapping segment from the point 60*b* to the pilot pin 64*b*, from the pilot pin 64*b* to the upper end of the wire knot 62, from the lower end of the wire knot 62 to the pilot pin 64*a* and from the pilot pin 64*a* to the point 60*a*. The vertical separations $y_1$ through $y_4$ correspond in order to the vertical separation between the path 45 and pilot pin 64*b*, between the pilot pin 64*b* and the upper end of the wire knot 62, between the lower end of the wire knot 62 and the pilot pin 64*a* and between the pilot pin 64*a* and the point 60*a*. The horizontal separations $x_1$ through $x_4$ correspond in order to the horizontal separations between the point 60*b* and the pilot pin 64*b*, between the pilot pin 64*b* and the upper end of the wire knot 62, between the lower end of the wire knot 62 and the pilot pin 64*a* and between the pilot pin 64*a* and point 60*a*. Various mathematical relationships between these quantities include:

Total Wire Length≡P=H+2W+L+$s_1$+$s_2$+$s_3$+$s_4$

Total Area Enclosed By Strapping=Cross-Section Area of Bale+Area Between Bale and Free Strapping=(H×W)+Ω

Where:

$$\Omega \equiv \text{Area Between Bale and Free Strapping} \Rightarrow$$

$$\Omega = \left[D \times \left(H - \sum_{i=1}^{4} y_i\right)\right] + [y_2 \times x_1] + [y_3 \times x_4] + \frac{1}{2}\{[x_1 \times y_1] + [x_2 \times y_2] + [x_3 \times y_3] + [x_4 \times y_4]\}$$

$s_i$ are determined exactly by the formula $s_i=\sqrt{x_i^2+y_i^2}$ where i: 1→4

For a given baling project the quantities H, W & P are generally prescribed by the job requirements. These requirements, the strapping utilized and particulars of the bale binding apparatus, will prescribe ranges for D & L. Thus, the $x_i$ & $y_i$, or equivalently, the $s_i$ are the primary free design variables.

In view of the foregoing, it will be seen that the several advantages of the invention are achieved and attained.

The embodiments were chosen and described in order to best explain the principles of the invention and its practical application to thereby enable others skilled in the art to best utilize the invention in various embodiments and with various modifications as are suited to the particular use contemplated.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A method of guiding a baling strap through a compression block of a bale compressor comprising:

dimensioning a guide track section to traverse a distance substantially as wide as the compression block;

pivotably moving said guide track section toward the compression block and inserting said guide track section into a slot in the compression block so that said guide track section is in close proximity to a previous guide track section and a subsequent guide track section; and orienting a first end of said guide track section to receive the baling strap from said previous guide track section; and directing the baling strap out a second end of said guide track section and into said subsequent guide track section.

2. The method of claim 1 wherein at least one of said previous and said subsequent guide track sections is provided in a slot in an opposing compression block.

3. The method of claim 1 wherein the strap is a wire.

4. The method of claim 1 wherein said directing step is further comprised of the steps of:

providing each guide track section with a channel created by opposing longitudinal guide track section halves for guiding the strap; and biasing said longitudinal guide track section halves together, said biasing being of a strength pre-configured to be overcome by a tensioning of the strap for release, when a baling operation tensions the strap.

5. The method of claim 4 wherein said biasing is by a spring.

6. A method of guiding a strap around a compressed bale of bulk material comprising:

receiving a driven strap into a first segment of a first guide track section;

directing the driven strap from said first segment of said first guide track section into a second guide track section;

directing the driven strap from said second guide track section into a third guide track section;

directing the driven strap from said third guide track section into a second segment of said first guide track section; and directing the driven strap into a strap fastener, said strap fastener being positioned generally between said first segment of said first guide track section and said second segment of said first guide track section;

whereby the driven strap is guided into a loop surrounding the bale; and pivotably removing said second guide track section from operative communication with said first guide track section and said third guide track section, after a bale has been bound.

7. The method of claim 6 further comprising the steps of:

engaging said second guide track section with both of said first guide track section and said third guide track section by moving said second guide track section from a removed position to an engaged position; and removing said second guide track section to said removed position after a bale is bound such that the bound bale may be ejected.

8. The method of claim 6 wherein said strap is a wire.

9. The method of claim 6 wherein at least one of said directing steps turns the strap 90°.

10. The method of claim 9 wherein said turn is through a radius of substantially about 6 to 7 inches.

11. The method of claim 6 wherein said first guide track section turns the strap through two 90° turns and said second guide track section turns the strap through two 90° turns.

12. The method of claim 11 wherein each of said 90° turns are through a radius of substantially about 6 to 7 inches.

13. The method of claim 6 wherein said directing steps are each further comprised of the steps of:

providing each guide track section with a channel created by opposing longitudinal guide track section halves for guiding the strap; and biasing said longitudinal guide track section halves together, said biasing being of a strength pre-configured to release the strap when a baling step of tensioning the strap occurs.

14. The method of claim 13 wherein said biasing is by a spring.

15. A method of guiding a bulk material bale strap in cooperation with a bulk material compressor comprising:

disposing a first guide track section in a first stationary compression block, said guide track section being dimensioned to substantially traverse the width of the first compression block;

inserting a second guide track section into a second, moving compression block, the second, moving compression block having a compressed position and a removed position, said inserting step being at the second, moving compression block compressed position, and said insertion placing said second guide track section in operative engagement with said first guide track section and with a third guide track section; and driving a baling strap through said third guide track section, said third guide track section being placed in operative engagement with said second guide track section when said second guide track section is inserted, and said third guide track section also being in operative engagement with said first guide track section, such that said first, second and third guide track sections direct said driving of the bale strap in a circuit surrounding a bale of bulk material.

16. The method of claim 15 wherein said second guide track section is moved after a baling processing step of fastening the bale strap around the volume of bulk material to a position sufficiently removed from the bound bale to allow ejection of the bound bale.

17. The method of claim 15 further comprising the steps of:

projecting into said bale strap circuit surrounding the bale at least one tensioning pin before a baling process step of fastening the bale strap; and removing said at least one tensioning pin from the bale strap circuit surrounding the bale before the second, moving compression block releases compression.

18. The method of claim 15 further comprising the steps of:

providing at least one of said guide track sections with a channel created by opposing longitudinal guide -track section halves for guiding the strap; and biasing said, longitudinal guide track section halves together, said biasing being of a strength pre-configured to be overcome by a tensioning of the strap for release, when a baling operation tensions the strap.

19. The method of claim 18 wherein said biasing is by a spring.

20. The method of claim 15 wherein said driving step further comprises directing the strap through at least one 90° turn.

21. The method of claim 20 wherein said at least one 90° turn is through a radius of substantially about 6 to 7 inches.

22. The method of claim 15 wherein said strap is a wire.

23. A method of baling bulk material comprising:

driving a strap into a first segment of a first guide track section;

directing the strap from said first segment of said first guide track section into a second guide track section, said second guide track section being in a first position engaged in operative cooperation with both said first segment of said first guide track section and with a third guide track section, and said second guide track section first position being inserted into a first compression block of a bulk material bale compressor;

directing the strap from said second guide track section into said third guide track section, said third guide track section being disposed to convey the strap through a second compression block of the bulk material bale compressor;

directing the strap from said third guide track section to a second segment of said first guide track section;

directing the driven strap from said second segment of said first guide track section into a fastener;

tensioning the strap to remove the strap from said first, second and third guide track sections, said tensioning being sufficient to overcome a first, second and third retaining guide track biaser incorporated into each of said first, second and third guide track sections;

cutting the strap to a pre-determined length; and fastening together lead and trailing ends of the straps.

24. The method of claim 23 further comprising the step of:

removing said second guide track section to a second position removed from insertion with the first compression block such that a bound bale may be ejected.

25. The method of claim 23 further comprising the steps of:

projecting at least one tensioning pin between at least one of said guide track sections and the bulk material before said tensioning step; and retracting said tensioning pins after said fastening step.

26. The method of claim 23 wherein said directing steps are further comprised of:

providing said guide track sections with a channel created by opposing longitudinal guide track section halves for guiding the strap, each said guide track biaser biasing said longitudinal guide track section halves together, said biasing being of a strength pre-configured to be overcome when the strap is tensioned for release.

27. The method of claim 26 wherein said biasing is by a spring.

28. The method of claim 23 wherein said driving step further comprises directing the strap through at least one 90° turn.

29. The method of claim 28 wherein said at least one 90° turn is through a radius of substantially about 6 to 7 inches.

30. The method of claim 23 wherein said strap is a wire.

* * * * *